US006612147B2

(12) United States Patent
Beetz et al.

(10) Patent No.: US 6,612,147 B2
(45) Date of Patent: Sep. 2, 2003

(54) HAND OPERATABLE PLIERS

(75) Inventors: Horst Beetz, Stadtallendorf (DE); Kurt Battenfeld, Ebsdorfergrund-Wittelsberg (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 0 days.

(21) Appl. No.: 09/992,295

(22) Filed: Nov. 14, 2001

(65) Prior Publication Data

US 2002/0056309 A1 May 16, 2002

(30) Foreign Application Priority Data

Nov. 16, 2000 (DE) ..... 100 56 900

(51) Int. Cl.[7] ..... B21D 37/14

(52) U.S. Cl. ..... 72/409.16; 72/409.01; 72/450; 81/427.5; 81/416; 7/128

(58) Field of Search ..... 72/409.01, 450, 72/409.16; 29/751; 81/427.5, 415, 416, 423; 7/107, 128

(56) References Cited

U.S. PATENT DOCUMENTS

| | | | | |
|---|---|---|---|---|
| 1,475,273 A | * | 11/1923 | Bernard | 30/184 |
| 2,914,976 A | * | 12/1959 | Demler | 72/404 |
| 4,700,592 A | * | 10/1987 | Rommel | 81/355 |
| 5,153,984 A | | 10/1992 | Beetz et al. | |

FOREIGN PATENT DOCUMENTS

| | | |
|---|---|---|
| DE | 3411397 | 10/1985 |
| DE | 4023337 C1 | 10/1991 |
| DE | 44 19862 C1 | 11/1995 |

* cited by examiner

*Primary Examiner*—Allen Ostrager
*Assistant Examiner*—John S. Goetz
(74) *Attorney, Agent, or Firm*—Klauber & Jackson

(57) ABSTRACT

The present invention relates to hand operable pliers (1) including a pliers head (2) and a drive (3). The pliers head (2) includes a frame (4), a stationary jaw (7) and a movable jaw (8), and it is designed and arranged to be replaceable. The drive (3) includes two handles (21, 22) and a common joint (20) being designed and arranged to connect the handles (21, 22) to be pivotable about the common joint (20) and to allow for an opening movement and for a closing movement of the handles (21, 22). The common joint (20) forms a pressure bolt (23). The movable jaw (8) is designed and arranged to be detachably supported at the pressure bolt (23). The drive (3) further includes a plurality of connecting members (36) each being designed and arranged to be detachable, two pulling elements (30) being associated with the drive (3) and each having a first end (32) facing the pliers head (4) and a second end facing the handles (21, 22). The first end (32) is designed and arranged to be rotatably connected to the pliers head (4) by one of the connecting members (36) to form a connecting joint (31). The second end is designed and arranged to be non-detachably and rotatably connected to one of the handles (21 or 22). The drive (3) also includes a stop (25) being designed and arranged to be limit the opening movement of the handles (21, 22).

15 Claims, 7 Drawing Sheets

HAND OPERATABLE PLIERS

CROSS REFERENCE TO RELATED APPLICATIONS

This application claims the benefit of co-pending German Patent Application No. 100 56 900.5 entitled "Handbet ätigbare Zange zum Crimpen, Schneiden, Pressen o. dgl.", filed on Nov. 16, 2000.

FIELD OF THE INVENTION

The present invention generally relates to pliers which may be operated by hand. Such pliers are actuated by hand by two handles of a drive being pivoted with respect to one another to attain an actuation stroke. One of the end points of the actuation stroke corresponds to the opened position of the pliers, and the other end point of the actuation stroke corresponds to the closed position of the pliers. With such pliers, work pieces are processed in some way, for example, electrical conductors are connected to end sleeves or strands by pressing, wires are cut or work pieces are deformed. The head of the pliers includes a corresponding appropriate tool which usually is formed by two associated working jaws or pressing jaws being located inside the frame of the pliers head. Usually, one of the jaws is stationary, whereas the other jaw is supported to be movable with respect to the first jaw inside the frame of the pliers head. There is a great number of pliers including respectively designed jaws depending on the desired use of the pliers.

BACKGROUND OF THE INVENTION

Hand operable pliers are known from German Patent No. DE 34 11 397 C2. The known pliers include two main elements, namely a pliers head and a drive. Both elements are designed as plates. The pliers head includes a closed frame in which the stationary jaw is supported and in which the movable jaw is guided to be movable with respect to the stationary jaw. The movable jaw includes a protrusion being directed towards the drive, the protrusion ending in a circumferentially opened recess having the shape similar to a semicircle and contacting a pressure bolt of the drive at least during a part of the actuation stroke of the drive. The drive includes two handles being movable with respect to one another about a common joint. The common joint includes the pressure bolt at which the protrusion of the movable jaw is supported. In addition to the pliers head and to the drive, two pulling tongues are arranged as third elements. The ends of the pulling tongues facing the pliers head are connected to the frame of the pliers head by connecting joints, while their other ends are connected to the handles by joints. The four joints include detachable bolts in a way that the drive including the handles may be connected to different pliers heads by using the pulling tongues. In this way, different tools may be alternatively connected to the same drive. However, it is not easy to exchange or replace a pliers head. Certain skills are required, and it is necessary to understand the construction of the pliers. The four detachable bolts may not get lost during the exchange, and they may not be interchanged. To introduce the bolts, the respective elements have to be aligned in a respective position. This is not easy since the pulling tongues— even when they are connected to the frame of the pliers head after pushing the two bolts of the connecting joints in— still are freely pivotable. Consequently, it is necessary to align the ends of the pulling tongues facing the drive with respect to the axes of the connecting joints at the side of the drive. This alignment is not possible in the closed position of the handles of the drive since the movable jaw is located in the opened position at the pliers head due to opening springs usually being located in the pliers head. On the other hand, there is the problem of the handles of the drive not having a defined opening position. Instead, in the dismounted position of the pliers head, they may be opened to an extent that the handles enclose an angle of approximately 180 degrees. The elements of the connecting joints cannot be positioned in a way that the bolt may be easily inserted.

Another trend of development in the art of controlling the majority of jaws without having to manufacture complete pliers is known from German Patent No. DE 40 23 337. A majority of dies is located at one jaw in a concentrated way. The jaw is arranged to be pivotable about an axis being located in a direction perpendicular to the plane of main extension of the frame in a way that the different dies being associated with different sizes may be alternatively used. The parts of the pliers are not designed to be detached from each other.

Furthermore, pliers including exchangeable jaws are known in the art. In this way— when the desired application changes— only the respective jaw is exchanged. Special constructive precautions have to be met to guide and to support the respective jaw.

SUMMARY OF THE INVENTION

The present invention generally relates to pliers for processing work pieces. More particularly, the present invention relates to hand operable pliers including a pliers head and a drive. The pliers head includes a frame, a stationary jaw and a movable jaw, and it is designed and arranged to be replaceable. The drive includes two handles and a common joint being designed and arranged to connect the handles to be pivotable about the common joint and to allow for an opening movement and for a closing movement of the handles. The common joint forms a pressure bolt. The movable jaw is designed and arranged to be detachably supported at the pressure bolt. The drive further includes a plurality of connecting members each being designed and arranged to be detachable, two pulling elements being associated with the drive and each having a first end facing the pliers head and a second end facing the handles. The first end is designed and arranged to be rotatably connected to the pliers head by one of the connecting members to form a connecting joint. The second end is designed and arranged to be non-detachably and rotatably connected to one of the handles. The drive also includes a stop being designed and arranged to be limit the opening movement of the handles.

The present invention also relates to a pliers system including a plurality of pliers heads and plurality of drives which may be differently combined and interconnected to realize different types of pliers for different operations on work pieces, for example for crimping, connecting, pressing, cutting and so forth.

The novel pliers have a design which makes it easier to handle them. Different pliers heads may be easily and quickly coupled to different drives for actuating the pliers.

In the novel pliers, the pulling elements or pulling tongues are not used as a third element in addition to the pliers head and to the drive, but they are clearly associated with the drive. This means that during an exchange of the pliers head, the pulling elements remain located at the drive, and only two connecting joints have to be loosened or detached. Additionally, the opening stroke or opening movement of the handle of the drive is limited by a stop. The drive unit has a determined, reproducible position in its opened position.

This opened position is located between the common joint of the handles acting as a pressure bolt and the two connecting joints of the pulling elements at the drive which may not be loosened. The axes of these three elements define a triangle which has a determined, defined relative position in the opened position. The pulling elements are pivotable about the connecting joints at the side of engagement, and they may not be loosened at this place. However, during this pivotal movement, the first ends facing the pliers head are guided on defined circular arcs such that the aligned position between the first ends of the pulling elements facing the pliers head and the frame of the respective pliers head is easy to be found to insert bolts or other detachable connecting members in the coupled position of the pliers. In this way, the exchangeable pliers head and the drive together form actuatable pliers. The alignment between the movable jaw of the respective pliers head and the pressure bolt of the common joint of the drive is automatically achieved without requiring special skills. The position of the jaw being movably guided in the pliers head is used. Usually, opening springs are located in each pliers head, the opening springs moving the movable jaw to reach and maintain a position corresponding to the limited opening position of each drive.

It is especially preferred if the first ends of the pulling elements of the drive facing the pliers head are coupled with one another at a determined distance by a connecting element or a yoke. The distance corresponds to the distance between the axes of the connecting joints. The inserted connecting element is an additional element being associated with the respective drive. Each drive includes at least one connecting element. In many cases, it includes two connecting elements in a symmetric arrangement with respect to the plane of main extension of the pliers. This plane is defined by the pliers head and by the drive. To alternately couple the drives and the pliers heads being part of an exchangeable pliers system, the connecting element determines one common distance between the axes of the connecting joints for the connection. The connecting element is permanently connected to the ends of the pulling elements facing the pliers head in a pivotal way such that a four point joint system is defined. In this way, when one axis of a connecting joint is positioned, the axis of the other connecting joint is also positioned as desired. As soon as one securing member has been inserted, the other securing member may also be easily inserted.

In an especially preferred embodiment of the novel pliers, the connecting element is linearly guided at the drive. The linear guidance of the connecting element is aligned in a direction towards the drive of the pliers head. In this way, the determined, fixed distance between the axes of the connecting joints is fixedly determined in space with respect to the pressure bolt of the common joint of the handles. The three connecting points or connecting locations have a definite, reproducible position with respect to one another in the opened position of the pliers such that the three respective connecting points of each pliers head being located in the same position with respect to one another may be arranged to overlap with one single movement. Consequently, exchanging the pliers head or the drive being connected to the pliers head is especially easy.

In an especially preferred constructive design of the novel pliers, the connecting element may be guided at the pressure bolt of the common joint of the handles of the drive. The pressure bolt forms the stop for a limited stroke at least in the opening direction. The pressure bolt forming the stop also limits the opening stroke of the handles and the relative position of the pressure bolt with respect to the connecting joints. The opened position of the drive, meaning the angle between the two handles of each drive being defined by the stop, is the exchanging position for the pliers head. The three connecting points being located at the drive, meaning the axes of the elements of the connection joints of the pulling elements facing the pliers head and the axes of the common pressure bolt of each drive are located at the same relative position and space as the axes of the respective connecting elements at each pliers head. These elements of the pliers head are also located in the opened position. This is caused by opening springs being located in the pliers head and a respective limitation of the stroke of the movable jaw in the pliers head.

Especially, the connecting element or the yoke may include an elongated hole through which the pressure bolt of the common joint of the two handles of the drive protrudes. Such an elongated hole at least at one of its ends should be designed to be circumferentially closed to form the limitation for the opened position of the handles of the drive. Its other end may also be designed to be closed to limit the closed position. In many cases, and especially in case when the closed position is designed to be adjustable, such a limitation is not required, or if it exists, it is located at a place at which it is not active.

There are a number of different possibilities of designing the pulling elements and/or the detachable connecting members. It is advantageous if the detachable connecting members are associated with the respective drive. As detachable connecting members, bolts which may be pulled out, screws including nuts or such not including nuts, guide pins and the like may be used. The pulling members may also have a variety of designs. It is especially advantageous if the ends of the pulling members facing the pliers head have a cranked design in a direction perpendicular to the plane of main extension of the pliers. Such a cranked design allows for the possibility of arranging the pliers head symmetrically with respect to the plane of main extension of the pliers. This is advantageous to uniformly transmit forces. Additionally, the cranked portions may form positioning stops to limit the insertion movement between the pliers head and the drive. This simplifies the insertion of the detachable connecting members. Especially, it is possible to design the ends of the pulling members facing the pliers head symmetrically with respect to the plane of main extension of the pliers to be cranked in a double way to form positioning supports for protrusions of the frame about the axes of the connecting joints. When the pliers head is exchanged, the pliers head to be newly inserted is guided with respect to the drive in two planes. Consequently, it reaches a limited insertion position in which the three connecting points with their axes are aligned such that the detachable connecting members may be inserted without additional centering efforts.

The detachable connecting members may be supported at the connecting element being associated with the drive to be movable in a direction perpendicular to the plane of main extension of the pliers to a limited extent. In this way, the detachable connecting members are captively connected and held at each drive. These connecting members are comparatively small elements which may easily get lost during assembly or disassembly of the pliers.

In a preferred embodiment of the novel pliers, the pulling members or connecting members, two connecting elements and the frame of the pliers head are designed and arranged to be substantially symmetric with respect to the plane of main extension. This arrangement allows for transmitting forces between the drive and the respective pliers head during use of the pliers in a good and safe way. The connecting members, especially insertion bolts, are not subjected to unbalanced bending forces. The two connecting elements or yokes may have identical designs.

In this way, a system of different hand operable pliers is achieved. The system includes a plurality of drives and a plurality of pliers heads which have a common determined mutual distance between the axes of the connecting joints and a common relative position of the pressure bolt with respect to the connecting joints. Usually, the number of pliers heads will be greater than the number of drives. It is especially preferred to use two drives only differing with respect to the lengths of the respective handles to change the forces which may be applied by hand at the respective pliers head in response to the necessary force demand.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
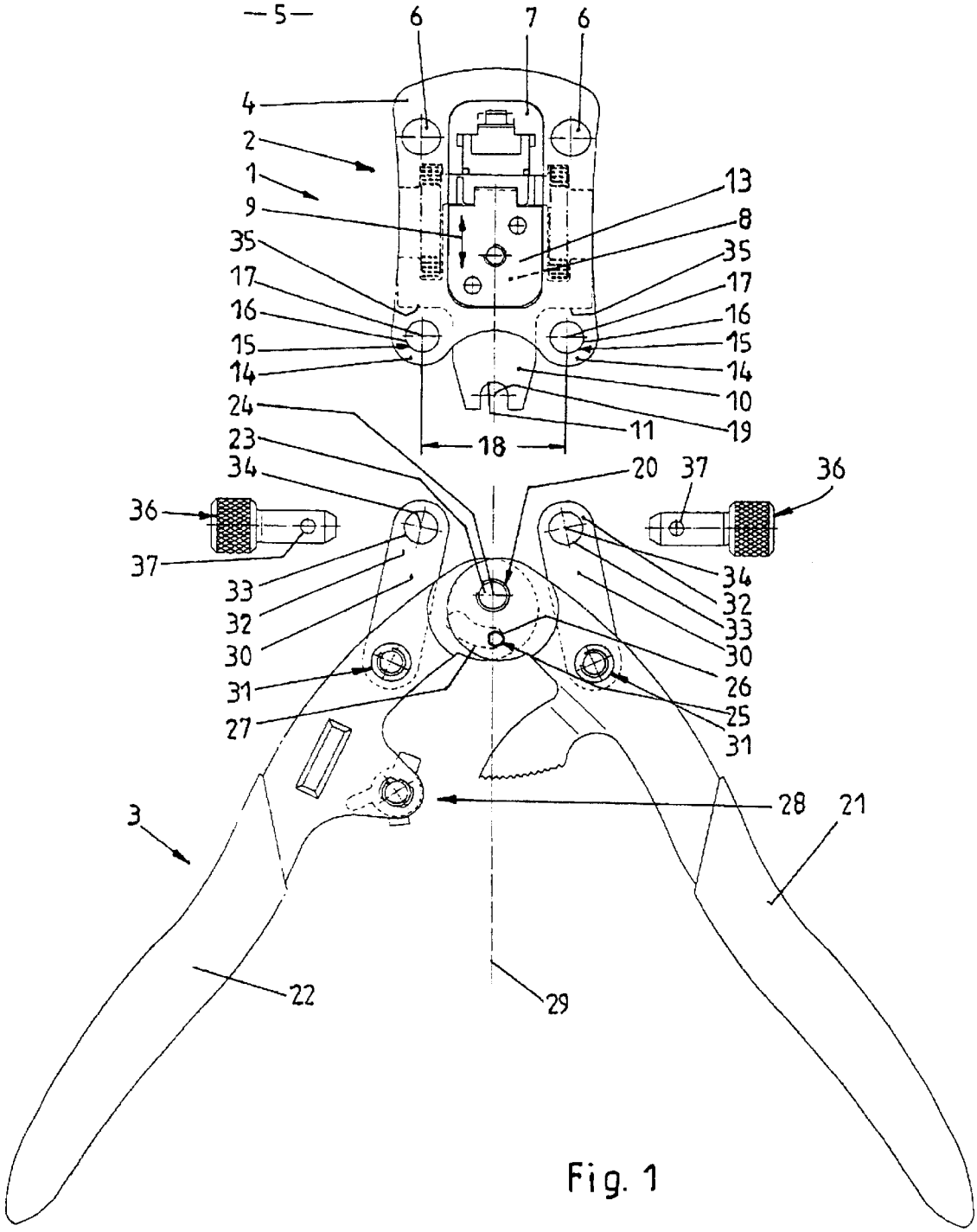
FIG. 1 is a view of a first exemplary embodiment of the novel pliers in the exchanging position.

Referring now in greater detail to the drawings, FIG. 1 illustrates important elements of a first exemplary embodiment of the novel hand operable pliers 1 in a dismounted position. The pliers 1 include two main units which are designed to be interconnected. The main units are a pliers head 2 and a drive 3.

Figure 2:
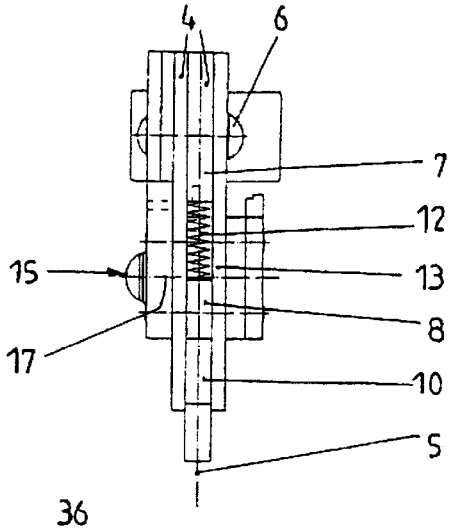
FIG. 2 is a side view of the pliers head according to FIG. 1.
Figure 4:
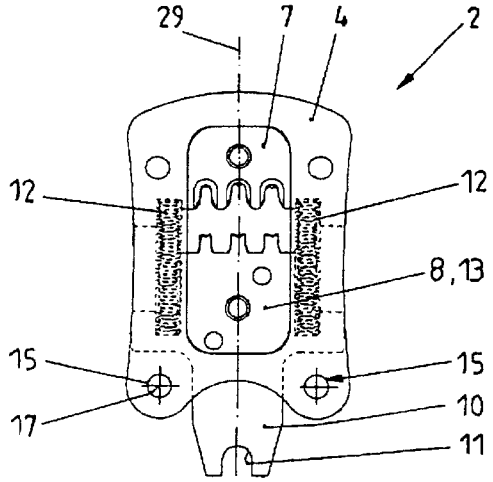
FIG. 4 is a view of another exemplary embodiment of the pliers head of the pliers.

The pliers head 2 includes a frame 4 which in this case has a continuous, closed design. Especially, the frame 4 may include two identical plates each having the shape of an O. The two identical plates are arranged in a spaced apart manner with respect to one another and with respect to a plane of main extension 5. The plane of main extension 5 is the plane of illustration of FIG. 1, and it is also to be well seen in FIGS. 2, 6. The two plates of the frame 4 and other elements may be fixedly connected by rivets 6 in a non-detachable way. Two jaws 7, 8 are arranged in the frame 4. The operating jaw 7 is a tool which is located in the frame 4 in a stationary way. The operating jaw 8 is arranged and guided in the frame 4 to be movable in the direction of double arrow 9. The jaws 7 and 8 are coordinated with one another, and they together form a tool for the use with work pieces. For example, the tool may be designed for pressing, cutting, crimping and the like. The jaw 8 is illustrated in the opened position in a way that it is possible to insert a work piece to be processed into the space between the jaws 7 and 8 in a direction perpendicular to the plane of main extension 5. For example, the work piece may be an electric cable, a wire, a conductor and the like. The movable jaw 8 includes a protrusion 10 which protrudes from the frame 4 in a direction towards the drive 3. A recess 11 is arranged at the free end of the protrusion 10. The recess 11 extends in a semicircle way up to a maximum of approximately 180 degrees, and it is designed to be opened in a direction towards the drive 3. Opening springs 12 are laterally located between the two plates of the frame 4 (FIGS. 2 and 4). During relief, the opening springs 12 move and hold the movable jaw 8 in the opened position. The jaw 8 also has a plate design, and it includes a guiding plate 13 which protrudes into a free space of one of the plates of the frame 4 in a way that it together with the frame 4 fulfills a guiding function during the stroke of the movable jaw 8. On the other hand, in combination with the opening springs 12, it limits the opened position of the jaw 8 by contacting the frame 4, as this is illustrated in FIG. 1.

Protrusions 14 are arranged at the part of the frame 4 facing the drive 3. The protrusions 14 may have the shape as to be seen in FIG. 1. Two joints 15 are arranged in the region of these protrusions 14. For this purpose, the frame 4 and the two plates forming the frame 4, respectively, include aligned bores 16. The axes 17 of the bores 16 are arranged at a defined distance 18. The recess 11 also has an axis 19. A triangle is formed by the axes 17, 19, the size of which is constant.

The drive 3 includes two handles 21, 22 which are designed and arranged to be pivotable about a common joint 20. For this purpose, a pressure bolt 23 protrudes through the two handles 21 and 22, the outer diameter of the pressure bolt 23 approximately corresponding to the diameter of the recess 11 being located at the movable jaw 8. The diameters are coordinated in a way that the pliers head 2 with its circumferentially opened recess 11 contacts the pressure bolt 23 during assembly of the pliers head 2 and the drive 3. In this case, the axis 19 of the recess 11 and the axis 24 of the pressure bolt 23 coincide. The drive 3 including the two handles 21 and 22 is illustrated in the opened position which— at the same time— is the exchanging position in which the user of the pliers may chose to connect one pliers head 2 from a plurality of usable pliers heads 2 of different designs to be connected with the drive 3. The opened position is limited and defined by a stop 25. The limitation of the opening movement may be realized in different ways. This limitation is to be understood as determining the relative position of the two handles 21 and 22 with respect to one another in a way that the maximum position is determined. In the exemplary embodiments of the novel pliers 1 of FIGS. 1 and 3, a transverse bolt 26 is supported at the handle 21. The handle 21 may also include a plurality of plates. The transverse bolt 26 protrudes through an elongated hole 27 being located in the other handle 22 and having a circular design. The opened position is limited in the end position between the transverse bolt 26 and the elongated hole 27. The other end position may correspond to the predetermined end position (for example the pressing position or the processing position) between the jaws 7 and 8. Alternatively, it may allow for a certain additional stroke in case the end pressing position is designed to be adjustable by additional elements (not illustrated).

A locking unit 28 is located between the two handles 21 and 22 in a known way. The locking unit 28 serves to reproducibly reach an end position between the jaws 7 and 8. Such locking units 28 are well known in the art, and therefore further description is not necessary.

The drive 3 further includes two pulling elements 30 being arranged in a symmetric way with respect to a longitudinal axis 29. The pulling elements 30, or at least their most important parts, are arranged approximately in the plane of main extension 5, or close to it, in a way that they either fit between the two plates of the frame 4, or they engage at least one of the plates 4 from the outside in case of a cranked design. The pulling elements 30 have an identical design. They each are connected to one of the handles 21 and 22, respectively, by connecting joints 31. The connecting joints 31 are not to be detached when a pliers head 2 and a drive 3 are to be assembled. The pulling elements 30 are clearly associated with the drive 3, and they always remain mounted at the respective drive 3. The connecting joints 31 are formed by bores being located in the respective elements and tappets or different elements protruding therethrough in a known way. The pulling elements 30 include fist ends 32 facing the pliers head 2. Bores 33 are located in the ends 32. Each bore 33 has an axis 34. The size of the bores 33 is coordinated with the bores 16, for example to have corresponding diameters. The pulling elements 30 in the position as illustrated in FIG. 1 are supported to be pivoted about the connecting joints 31 to a limited extent. During connection of a drive 3 and a pliers head 2, they may be pivoted to reach the position illustrated in FIG. 1 in which the distance of the axes 34 corresponds to the distance 18. Counter bearings 35 are located in the pliers head 2 between the plates of the frame 4 to centrically support the free ends 32 of the pulling elements 30 in a way that the three connecting locations are located and guided in space corresponding to the axes 17, 34 and 19, 24 during assembly of the pliers head 2 and the drive 3.

Detachable connecting members 36 are also part of the drive 3. For example, the connecting members 36 may be bolts which can be pulled out by the user of the pliers, as illustrated in FIG. 1. During assembly of the pliers head 2 and the drive 3, the connecting members 36 are inserted through the bores 33 and 16 in a way that the pliers head 2 is located at the drive 3 in a specific, determined way. Corresponding to the respective design of the jaws 7, 8, the pliers 1 may then be used to process work pieces. In case different work is to be done and different operation of the pliers is required, it may make sense or it may be necessary to exchange the pliers head 2 to use a different tool. For example, the different tool may require a different drive 3 being designed to apply greater forces. For example, the handles 21 and 22 may have a comparatively longer design to supply greater forces. It is intended that the novel pliers 1 and the novel pliers system, respectively, allows for the possibility of coupling and mounting a plurality of ready to use pliers heads 2 at one or more drives 3 to realize pliers of various functionalities.

Exchanging or replacing the pliers head 2 and the drive 3, respectively, is realized in a corresponding way. The pliers 1 are moved to reach their opened position in which the handles 21 and 22 are pivoted to reach the maximum opened position. In this position, the connecting members 36 are removed in a way that the respective pliers head 2 may be detached from the drive 3, as this is illustrated in FIG. 1. The connecting members 36 may include balls 37 being subjected by springs or other engaging units for locking units to arrange them in a captive way, as this will be used in combination with a special design which will be explained with respect to the exemplary embodiment of FIG. 5.

Figure 3:
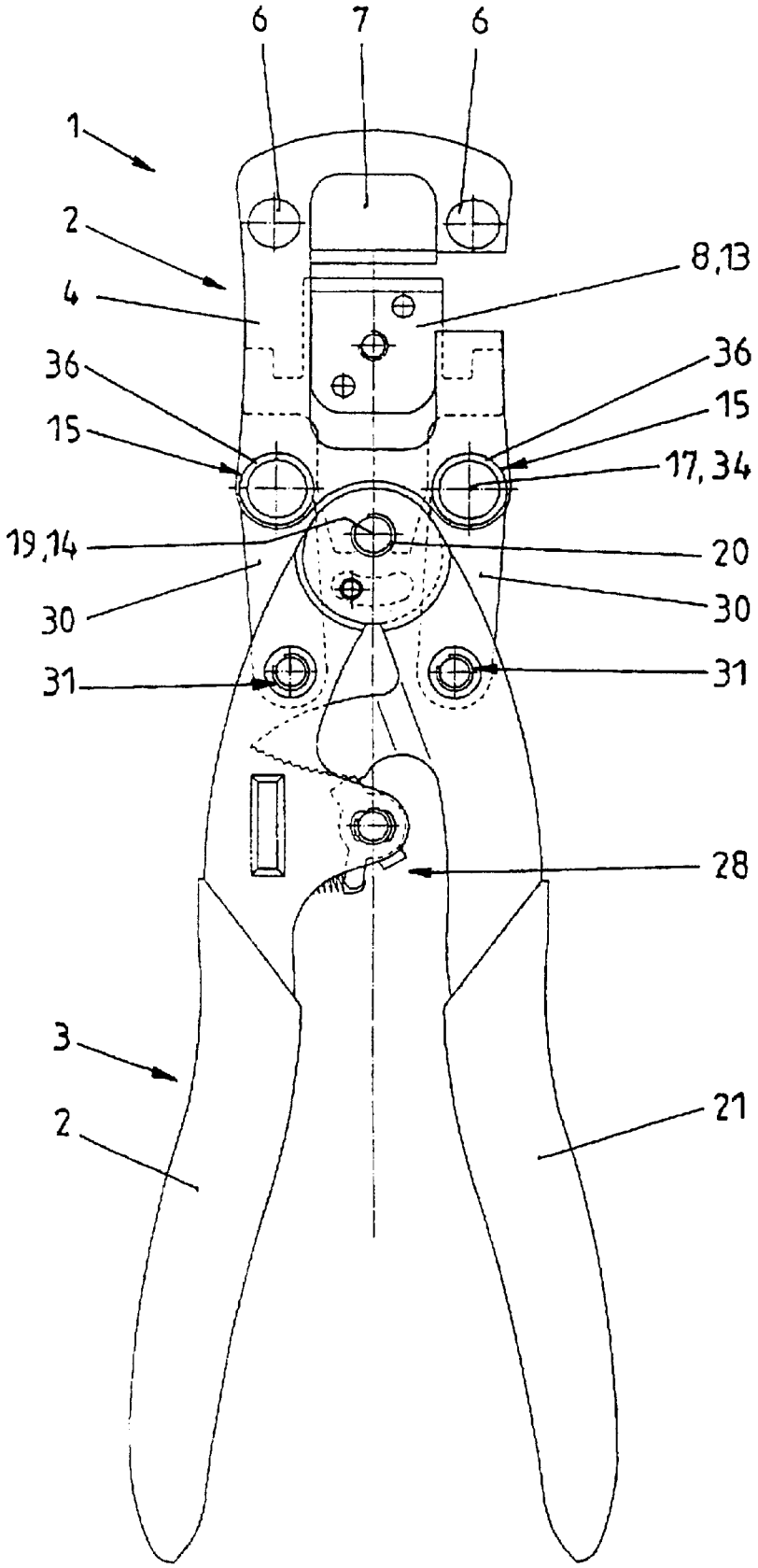
FIG. 3 is a view of another exemplary embodiment of the pliers in their assembled position and in the closing position of the pliers.

FIG. 3 further explains the closed position of another novel pliers 1 having a similar design to the pliers 1 of FIG. 1 to a great extent. However, the pliers head 2 in FIG. 3 includes a frame 4 having the shape of a C such that a work piece may be inserted in a lateral direction between the jaws 7 and 8. In the illustrated exemplary case, the jaws 7 and 8 are designed as pressing die. Since the closing position of the drive 3 is illustrated and the pliers 1 are shown in their mounted position, the jaws 7 and 8 are located in the end pressing position in which the locking unit 28 disengages such that it is possible to then open the pliers 1.

FIG. 4 illustrates another exemplary embodiment of the pliers head 2 including a closed frame 4, a stationary jaw 7 and a jaw 8 which is supported to be movable in a direction of the longitudinal axis 29 in a linear direction. The jaws 7 and 8 include three nests being associated with different sizes of crimping connections to be realized by the pliers. Again, the protrusion 10 with the recess 11 protrudes out off the frame 4 between the joints 15. The guiding plate 13 of the movable jaw 8 is to be well seen. Opening springs 12 are schematically illustrated. The pliers head 2 does not include counter bearings 25 (FIG. 1). The defined distance 18 between the axes 17 of the joints 15 is used.

Figure 6:
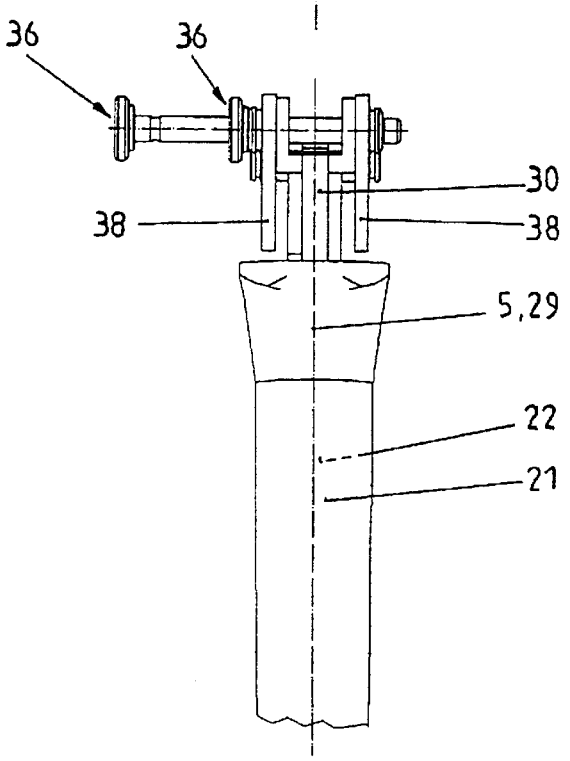
FIG. 6 is a side view of the drive according to FIG. 5.
Figure 5:
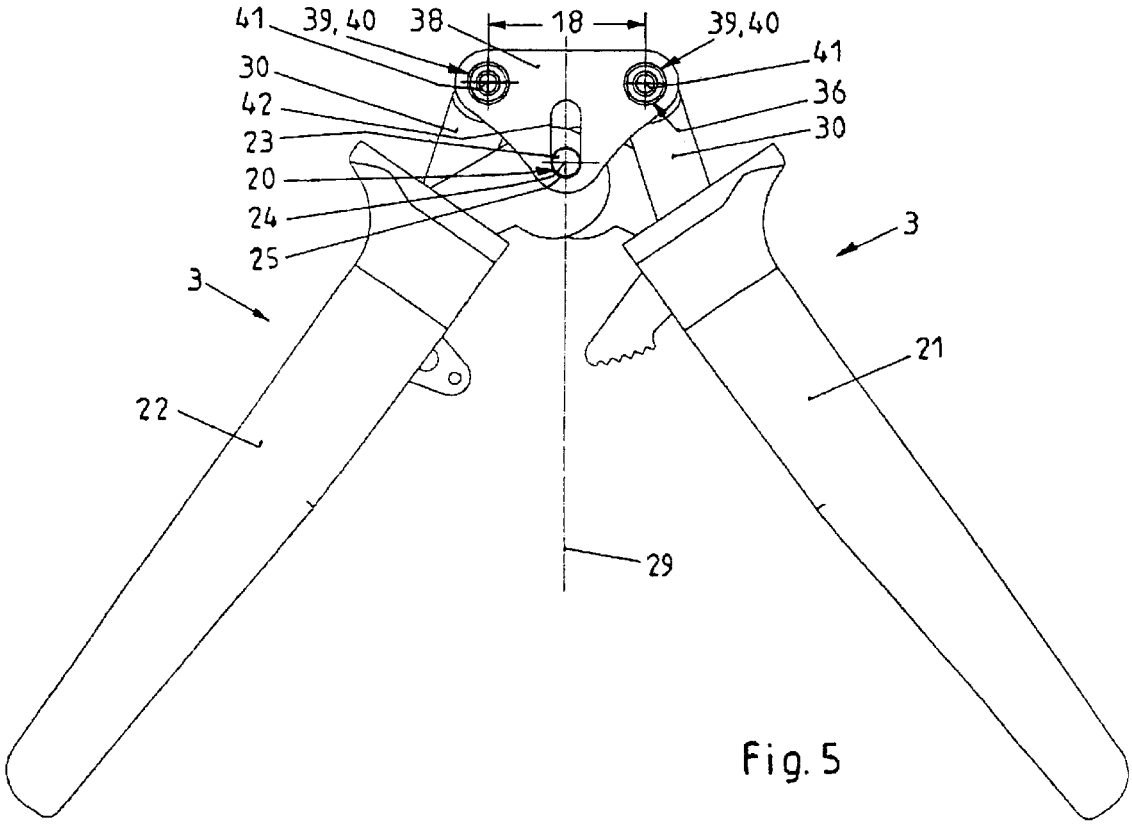
FIG. 5 is a view of another drive of the pliers in the opened position and in the exchanging position.

FIG. 5 illustrates a respective drive unit 3 with its two handles 21 and 22. The handles 21 and 22 are designed and arranged to be pivotable about the common joint 20 including the inserted pressure bolt 23. The pulling elements 30 are pivotally connected to the handles 21 and 22, respectively, in the same way. The connecting joints 31 cannot be seen in this illustration since they are located within the outline of the outer operating handles being connected to the handles 21 and 22. To adjust and to align the free end 32 of the pulling elements 30 facing the pliers head 2, a connecting element 38 is arranged at the drive 3 in the region of the common joint 20. The connecting element 38 which may also be called a yoke at least includes one plate being arranged at the outside and at a distance with respect to the plane of main extension 5. However, it is preferred to use two plates which together form the yoke 38 and which are arranged at the drive 3 to be symmetric with respect to the plane of main extension 5. The connecting element 38 is pivotally connected to the two pulling elements 30. For this purpose, there are joints 39 which are partly formed by bores 40. The diameters of the bores 40 correspond to the diameters of the bores 33 being located in the pulling elements 30 and to the diameters of the bores 16 being located in the pliers heads 2. The joints 39 include axes 41 being located at a defined distance 18. The joints 39 acting between the yoke 38 and the pulling elements 30 are designed to be non-detachable without destruction. Furthermore, the connecting element 38 and the two plates forming the connecting element 38, respectively, includes an elongated hole 42. The pressure bolt 23 of the common joint 20 protrudes through the elongated hole 42. A first end of the elongated hole 42 forms the stop 25 for determining the opened position and the exchanging position, respectively. The other end of the elongated hole 42 may be associated with the final processing position. The axes 41 and 22 in the opened position of the drive 3 form a triangle which corresponds to the triangle of the axes 17 and 19 of each pliers head 2 concerning size and position. The elongated hole 42 serves to guide the connecting element 38 with respect to the handles 21 and 22 in a direction of the longitudinal axis 29. In this way, the axes 41 and 24 have a defined position with respect to one another in the opened position of the drive 3. It is to be seen from FIG. 5 that the connecting members 36 being designed as bolts which may be pulled out are associated with the drive 3. This is to be even better seen in FIGS. 6 and 12. In FIG. 6, one of the bolts is illustrated in its pulled out position, whereas the other bolt 36 is illustrated to be pressed in. The bolt 36 even in the pulled out position is arranged at the connecting element 38 to be captive and not to get lost unintentionally.

Figure 7:
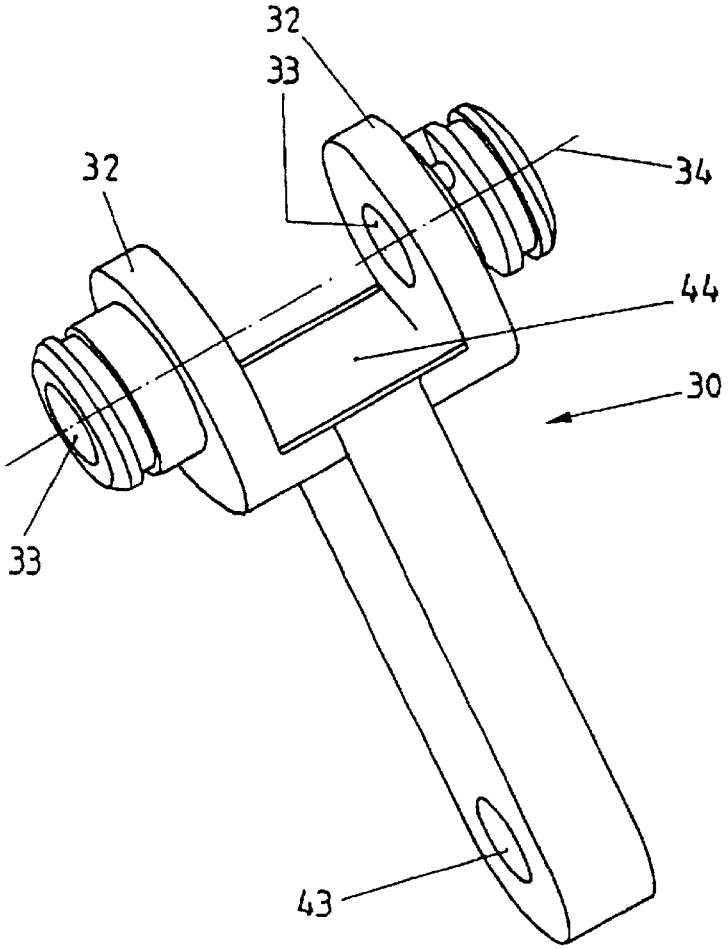
FIG. 7 is a perspective view of an exemplary embodiment of a pulling member of the pliers.

FIG. 6 already shows the special design of the pulling element 30 which is then shown in even greater detail in FIG. 7 as a perspective illustration. The pulling element 30 includes a bore 43 to form part of the connecting joint 31. The pulling element 30 in the region of the first free ends 32 is designed to be cranked twice, meaning towards both sides, such that there is an intermediate space with a rounded positioning bearing 44 the design and arrangement of which (with respect to the axis 34) is coordinated with the design of the protrusions 14 of the frame 4 of the pliers head 2 (with respect to the axes 17). In this way, a centering effect of the pliers head 2 with respect to the drive 3 is reached during insertion. The axes 34 and 17 get to be aligned in a way that the connecting members 36 may be slightly pressed in at both connecting joints 15. It is to be understood that the respective centering effect has taken place between the pressure bolt 23 and the recess 11 during assembly.

Figure 8:
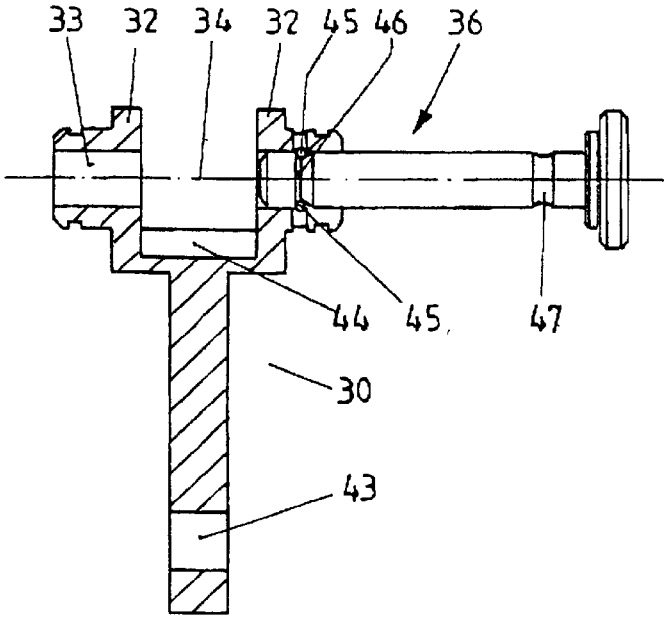
FIG. 8 is a detailed view of a captive connecting member being located at the pulling member of the pliers.

FIG. 8 further emphasizes the captive support of a connecting member 36 being designed as a bolt to be pulled out in the region of the yoke 38. The pulling element 30 in its region of the first free ends 32 is cranked to two sides. There, the axis 34 with the bore 33 protruding through both ends 32 is formed. The bolt being guided to be movable to a limited extent is arranged in the bore 33 as connecting member 36. The bolt in its two end positions is locked by one or more bolts 45 (not illustrated) being subjected by springs and engaging channels 46 and 47, respectively.

Figure 9:
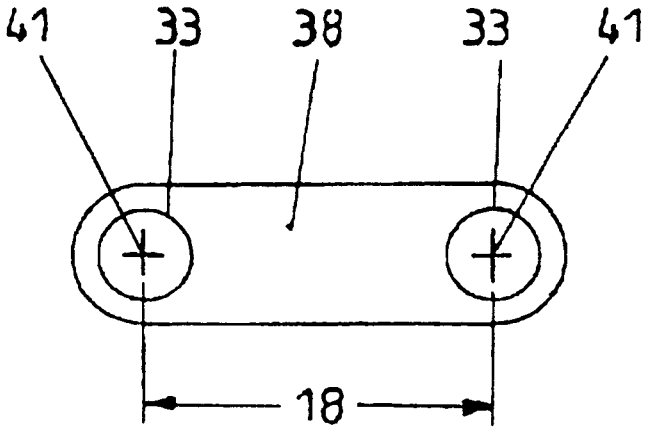
FIG. 9 is a view of a first exemplary embodiment of a connecting element of the pliers.
Figure 10:
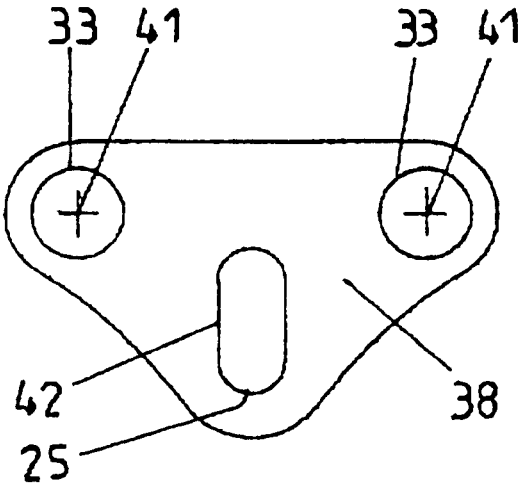
FIG. 10 is a view of a second exemplary embodiment of the connecting element.
Figure 11:
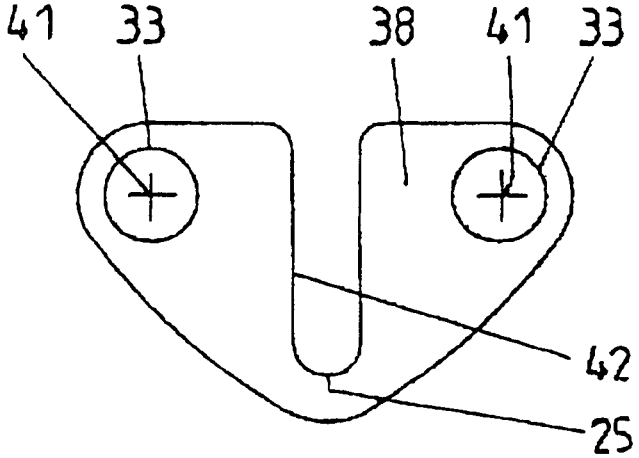
FIG. 11 is a view of a third exemplary embodiment of the connecting element.

FIGS. 9 through 11 illustrate exemplary embodiments of the yoke or the connecting element 38. The yoke 38 illustrated in FIG. 9 only includes two bores 40 being located at a distance 18. The joints 39 are held with respect to one another by such a yoke 28. During exchange of the pliers head 2, it is necessary to attain the relative position with respect to the joint 20. FIG. 10 illustrates another exemplary embodiment in which this is automatically achieved. The yoke 38 of FIG. 5 is shown. FIG. 11 illustrates a yoke 38 which with one of the ends of the elongated hole 42 forms the stop 25 being designed and arranged to determine the opened position of the drive 3. The stroke or movement of the drive 3 from the opened position into the closed position is not limited by the locking unit 28. The limitation may be realized in a different way, for example by the jaws 7, 8 and/or by the locking unit 28 or by different stops being located to be active between the handles 21 and 22.

Figure 12:
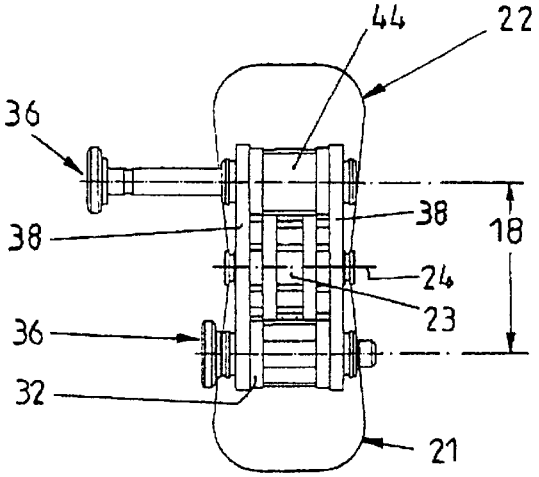
FIG. 12 is a front view of a drive of the pliers.

FIG. 12 clearly shows the distance 18 being defined by the yoke 38 and the relative position with respect to the axis 24 of the pressure bolt 23 in the exchanging or replacing position. It is to be understood that both connecting elements 36 in the exchanging position are located in the pulled out, captive position. The two connecting elements 36 are only illustrated in their two end positions to clearly show these positions.

Figure 13:
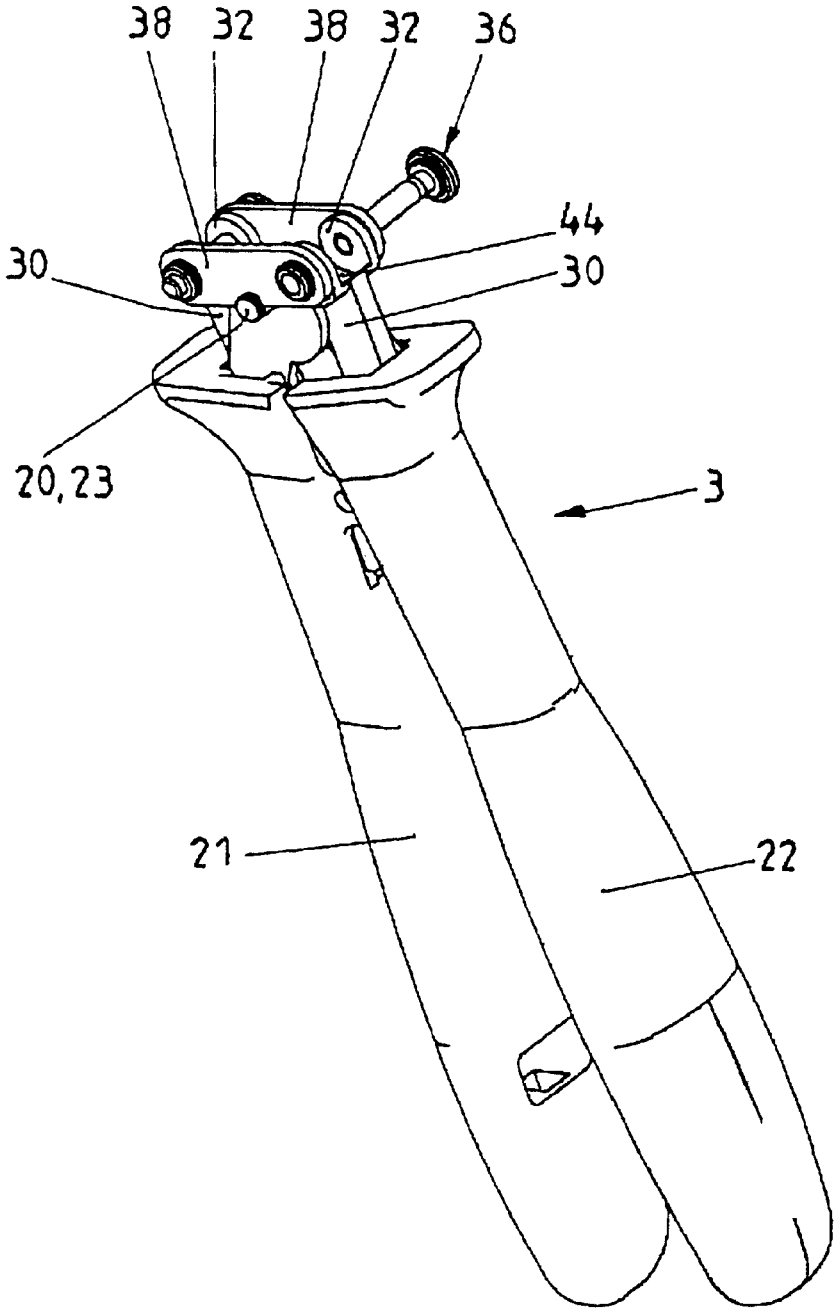
FIG. 13 is a perspective view of another drive including a connecting element similar to FIG. 9.

FIG. 13 illustrates a drive 3 including comparatively longer handles 21 and 22. The drive 3 is especially suitable to apply great pressing forces or to require little actuation forces. A yoke 38 being similar to the one illustrated in FIG. 9 is used. The positioning bearings 44 in the region of the free end 32 of the pulling elements 30 are to be well seen. The drive 3 is illustrated in its closed position. The closed position is limited by the pressure bolt 23 of the joint 20 contacting the yoke 38. One of the two connecting members 36 is illustrated in the pulled out position in which it is held at the connecting element 38 in a captive manner.

Many variations and modifications may be made to the preferred embodiments of the invention without departing substantially from the spirit and principles of the invention. All such modifications and variations are intended to be included herein within the scope of the present invention, as defined by the following claims.

We claim:

1. Hand operable pliers, comprising:

a pliers head including a frame, a stationary jaw and a movable jaw and being designed and arranged to be replaceable; and a drive including two handles, a common joint being designed and arranged to connect said handles to be pivotable about said common joint and to allow for an opening movement and for a closing movement of said handles, said common joint forming a pressure bolt, said movable jaw being designed and arranged to be detachably supported at said pressure bolt, a plurality of connecting members each being designed and arranged to be detachable, two pulling elements being associated with said drive and each having a first end facing said pliers head and a second end facing said handles, said first end being designed and arranged to be rotatably connected to said pliers head by one of said connecting members to form a connecting joint having an axis, said second end being designed and arranged to be non-detachably and rotatably operatively connected to one of said handles, at least one connecting element being designed and arranged to operatively connect said first ends of said pulling elements facing said pliers head to be located at a predetermined distance with respect to one another, the said distance corresponding to a distance between the axes of said connecting joints, and a stop being designed and arranged to be limit the opening movement of said handles.

2. The pliers of claim 1, wherein said at least one connecting element is designed and arranged to be linearly guided at said drive.

3. The pliers of claim 2, wherein said stop is formed by said pressure bolt.

4. The pliers of claim 3, wherein said stop is designed and arranged to guide said at least one connecting element to limit a movement of said connecting element in at least an opening direction of said handles, and wherein said stop is designed and arranged to determine a relative position of said pressure bolt with respect to said connecting joints.

5. The pliers of claim 4, wherein said at least one connecting element includes an elongated hole, and wherein said pressure bolt is designed and arranged to extend through said elongated hole.

6. The pliers of claim 1, wherein said pliers have a plane of main extension being defined by said pliers head and by said drive, and wherein said first ends of said pulling elements facing said pliers head have a cranked design in a direction approximately perpendicular to the plane of main extension.

7. The pliers of claim 1, wherein said pliers have a plane of main extension being defined by said pliers head and by said drive, and wherein said first ends of said pulling elements facing said pliers head have a double cranked design in a direction approximately symmetric to the plane of main extension.

8. The pliers of claim 7, wherein said frame includes a plurality of protrusions, wherein said connecting joints have axes and wherein said first ends form positioning supports for said protrusions about the axes.

9. The pliers of claim 1, wherein said pliers have a plane of main extension being defined by said pliers head and by said drive, and wherein said connecting members are designed and arranged to be movably supported at said at least one connecting element in a direction approximately perpendicular to the plane of main extension.

10. The pliers of claim 1, further comprising a second connecting element, wherein said pliers have a plane of main extension being defined by said pliers head and by said drive, and wherein said two connecting elements, said pulling elements and said frame are designed and arranged to be approximately symmetric to the plane of main extension.

11. The pliers of claim 1, further comprising a plurality of pliers heads and a plurality of drives to be alternately combined, wherein each of said connecting joints of said plurality of drives has an axis being located at a predetermined distance with respect to the axis of said other connecting joint, and wherein each pressure bolt of said plurality of drives has the same relative position with respect to said connecting joints.

12. Hand operable pliers, comprising:

a pliers head including a frame, a stationary jaw and a movable jaw; and a drive unit including two handles being designed and arranged to operate said pliers, a common joint being designed and arranged to connect said handles to be pivotable about said common joint and to allow for an opening movement and for a closing movement of said handles, said common joint forming a pressure bolt, said movable jaw being designed and arranged to be detachably supported at said pressure bolt, a plurality of connecting members each being designed and arranged to be detachable, at least two pulling elements being associated with said drive unit and each having a first end facing said pliers head and a second end facing said handles, said first end being designed and arranged to be rotatably connected to said pliers head by one of said connecting members to form a connecting joint having an axis, said second end being designed and arranged to be non-detachably and rotatably connected to one of said handles, at least one connecting element being designed and arranged to operatively connect said first ends of said pulling elements facing said pliers head to be located at a predetermined distance with respect to one another, the said distance corresponding to a distance between the axes of said connecting joints, and a stop being designed and arranged to be limit the opening movement of said handles.

13. The pliers of claim 12, wherein said at least one connecting element is designed and arranged to be linearly guided at said drive.

14. Pliers system, comprising:

at least one pliers head including a frame, a stationary jaw and a movable jaw; and at least one drive unit including two handles being designed and arranged to operate said pliers by hand, a common joint being designed and arranged to connect said handles to be pivotable about said common joint and to allow for an opening movement and for a closing movement of said handles, said common joint forming a pressure bolt, said movable jaw being designed and arranged to be detachably supported at said pressure bolt, a plurality of connecting members each being designed and arranged to be detachable, at least two pulling elements being associated with said drive unit and each having a first end facing said pliers head and a second end facing said handles, said first end being designed and arranged to be rotatably connected to said pliers head by one of said connecting members to form a connecting joint having an axis, said second end being designed and arranged to be non-detachably and rotatably connected to one of said handles, at least one connecting element being designed and arranged to operatively connect said first ends of said pulling elements to be located at a predetermined distance with respect to one another, the distance corresponding to a distance between the axes of said connecting joints, and a stop being designed and arranged to be limit the opening movement of said handles.

15. The pliers system of claim 14, wherein said at least one connecting element is designed and arranged to be linearly guided at said drive.

* * * * *